US006102549A

United States Patent [19]

Thomas et al.

[11] Patent Number: 6,102,549

[45] Date of Patent: Aug. 15, 2000

[54] BATTERY POWER PACK AND TABLE LAMP THEREFOR

[76] Inventors: Stephen E. Thomas, 38840 Godfrey Pl., Fremont, Calif. 94539; Mark S. Thomas, 5058 Dunsmiur Common, Fremont, Calif. 94555

[21] Appl. No.: 09/046,002

[22] Filed: Mar. 23, 1998

[51] Int. Cl.[7] ..... F21L 4/00

[52] U.S. Cl. ..... 362/183; 362/202; 362/208

[58] Field of Search ..... 362/183, 202, 362/205, 208

[56] References Cited

U.S. PATENT DOCUMENTS 3,192,378 6/1965 Oldenburger ..... 362/183

4,823,241 4/1989 Trattner ..... 362/183

*Primary Examiner*—Sandra O'Shea
*Assistant Examiner*—John A. Ward
*Attorney, Agent, or Firm*—Linval B. Castle

[57] ABSTRACT

A portable lighting system comprised of a plug-in lamp and a rechargeable power pack having a single phone jack and two parallel circuits to the battery. When upright, a discharge circuit containing a mercury switch connects the battery to the lamp. When inverted, the discharge circuit is opened and the parallel circuit containing a diode allows current to only pass into the battery from the jack coupled to a battery charger. The system will provide light to table surfaces for commercial use such as restaurants, retirement homes as well as in private homes, such as for swimming pool areas and nurseries.

8 Claims, 2 Drawing Sheets

BATTERY POWER PACK AND TABLE LAMP THEREFOR

This invention relates to a rechargeable battery power pack and a plug-in lamp therefor.

BRIEF SUMMARY OF THE INVENTION

The power pack of the invention contains two separate circuits, one is for charging the power pack and the other is for discharging the power pack. These separate circuits never operate at the same time and are engaged through a single connector in one embodiment and in two connectors in another embodiment. In the case of the single connector, the connector is positioned for connecting the power pack to a charger and, when inverted, to a load such as an electric lamp bulb. When the power pack is oriented so that the connector is on top then the battery and associated discharge circuitry is engaged through a gravity controlled switch, such as a mercury switch. When the power pack is inverted, the gravity controlled switch is opened and the discharge path is interrupted.

In parallel with the gravity controlled switch is a separate circuit used during charging. This circuit is isolated and protected by a diode that is oriented to permit charging current to pass while blocking discharging current and is employed to protect against accidental battery discharge in the event of a short circuit experienced during the charging mode as described in my U.S. Pat. No. 5,587,646.

In the case where two connectors are employed in the power pack, the connectors are insert keyed to allow the proper mating with a plug to occur. As in the case with the single connector, separate charging and discharging circuits are employed.

BACKGROUND OF THE INVENTION

The battery power pack is a low voltage rechargeable battery source which is dischargeable and charged through the same connector by a battery charger in a manner similar to the rechargeable table lamp described in my U.S. Pat. No. 4,764,853. In that lamp the batteries were housed within the lamp assembly whereas the present lamp is light in weight and plugs into the heavier power pack which is in the lamp base to provide stability. Thus, in the former design the entire lamp assembly was removed for recharging the batteries whereas in the present system, only the power pack is removed and inverted for recharging through the same connector. There are other important differences which will become apparent in reading the disclosure.

Many advantages are inherent in this power pack and proposed lamp structure have been designed specifically to service markets which are interested in safety, cost and environmental considerations. They have many advantages over existing technologies.

Rechargeable power packs as a source of illuminating individual dining tables in restaurants and night clubs have a great advantage over AC power sources. The installation of AC power at each table would entail prohibitive expenses and would prevent the moving of tables to accommodate variations in customer groups. Further, the installation of AC outlets in the floor beneath the tables would present hazards to customers and would be dirt collectors, Rechargeable power packs also have the advantage over fossil fuel burning devices, such as candles and oil lamps. Although these fossil burning devices provide a certain charm and intimacy, they create a fire hazard, use up oxygen from the room, and also pollute the air with wax and soot from their exhaust. Open flame lamps require a relatively large hole above the flame light source since the open flame type lamp must have access to an air supply for burning and a means of exhausting heat into the atmosphere.

The electric rechargeable battery portable lamp requires no such restrictions while lending themselves to broader lamp design innovation and designs, such as color wheels and light reflectors to concentrate more light on the table surface. The power pack and lamp to be described separates the lighting assembly from the battery source; that is, the lighting assembly is made a functional part of the lamp fixture and the power pack is a simple dedicated battery pack mounted into the base of the lamp easily and quickly removable for recharging.

Briefly described, the preferred power pack includes a housing containing a rechargeable battery coupled to a phone jack through a gravity controlled switch which is closed only when the housing is oriented in the discharge position for receiving a phone plug from a lamp assembly. When inverted, the battery discharging circuit is opened. A charge circuit is accessed through an isolating diode allowing charging current into the a battery from an external battery charger.

BRIEF DESCRIPTION OF THE DRAWINGS

In the drawings which illustrate the preferred embodiment of the invention.

DETAILED DESCRIPTION OF THE PREFERRED EMBODIMENT

Figure 1:
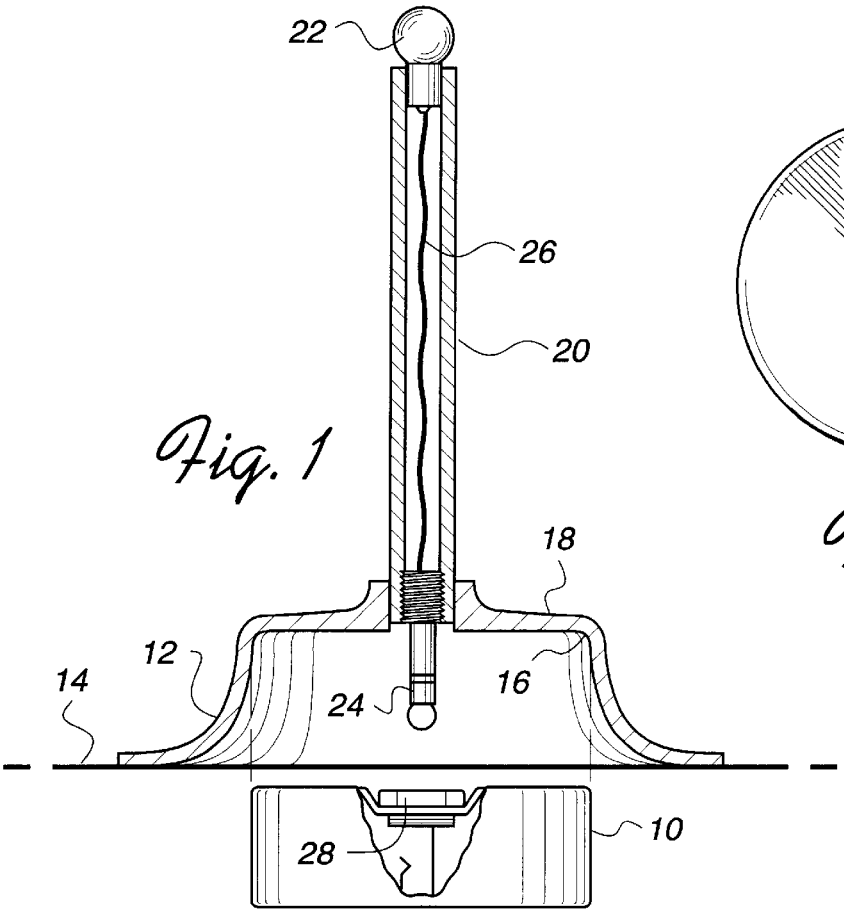
FIG. 1 is an illustration of a lamp assembly inserted into a battery power pack.

FIG. 1 is an elevational view of a power pack 10 and a typical table lamp fixture adapted to be connected to the power pack. The lamp fixture contains a light weight ornamental base 12 which covers the power pack 10 and rests on a table surface 14, and which may be formed from thin metal or plastic. The interior of the base 12 is circular and the upper wall 16 of the interior has a diameter and is configured so that, when the power pack 10 rests on the table surface 14, the interior of the base will grasp and confine the upper surface of the power pack to prevent its lateral movement.

Emanating from the center of the circular top surface 18 of the base 12 is a lamp stem, or chimney 20 which may be a tube of metal and plastic combination with dimensions determined by the application. The upper end of chimney 20 supports a small lamp 22. The lower end of the chimney is attached to the base 12 and to a male connector in the form of a 2-element phone plug 24. A small electrical conductor 26 extends from the phone plug 24 to the lamp 22. Alternatively, the lamp bulb 22 may be housed in a bulb holder with two separate conductors coupling it to the phone plug 24.

The power pack 10 is formed of a low profile housing, for example, approximately three inches in diameter and one inch thick. It will snugly fit under the lamp body 12 resting on the table surface 14 and is connected to the phone plug 24 in the lamp assembly by an axially mounted 2-element phone jack 28 in one of the circular surfaces, as shown in the plan view of FIG. 2.

The power pack 10 contains a pair of rechargeable batteries and is relatively heavy compared with the light weight lamp assembly. Because of its snug fit in the lamp base 12 and its connection through the phone plug 24, the power pack 10 provides stability to the complete lamp and will prevent accidental tipping of the lamp. Because of this stability, the lamp chimney 20 may be quite tall, and because of the low profile of the base, the lamp is able to illuminate the area of the table surface very close to its base.

Figure 3:
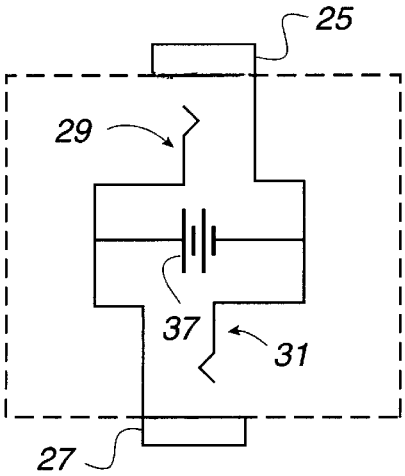
FIG. 3 is a schematic diagram of one type of rechargeable battery supply.

FIG. 3 is a schematic diagram of one type of rechargeable battery source that could be used with the lamp of FIG. 1. In FIG. 3 there are two phone jacks 25 and 27, each in the center of opposite surfaces of an electrically insulated housing represented in the drawing by broken lines. The body element of phone jack 25 is connected directly to the tip element of jack 27, and the body element of phone jack 27 is connected directly to the tip element of jack 25. A rechargeable battery 37 is connected between the two connecting wires. In this form of battery source, a battery charger may be connected to the jack 27 while a load, such as the lamp of FIG. 1 is connected into jack 25.

While suitable for providing current to table lamps, the type of battery supply of FIG. 3 is not suitable for some applications. Because of the phone jacks on each surface, the depth of the housing must be thicker. And there is no protection for the battery or the charger in the event of a short circuit in a phone plug, an occasional occurrence caused by carelessly inserting the plug into the jack.

Figure 2:
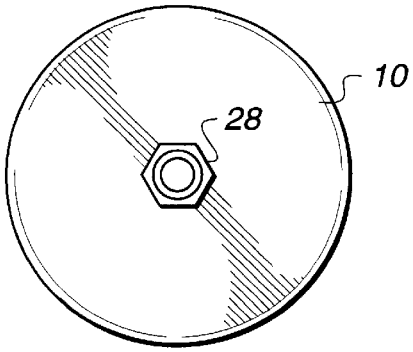
FIG. 2 is a top plan view of the power pack of the invention.
Figure 4:
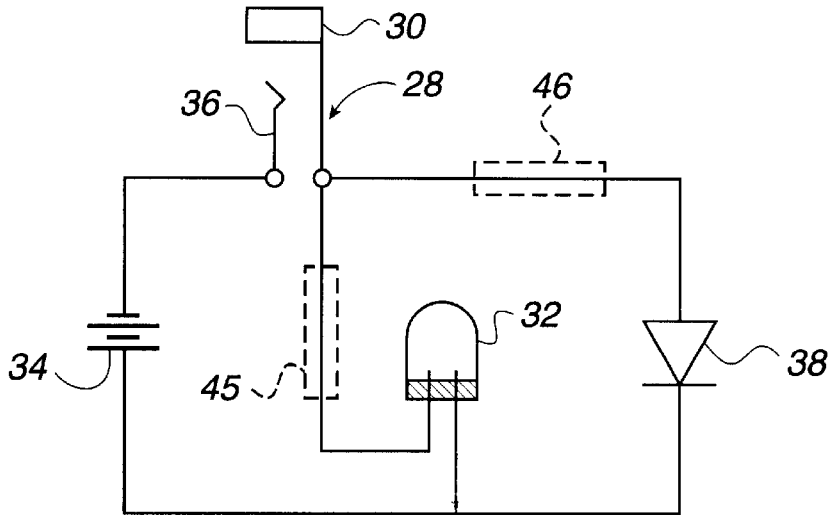
FIG. 4 is a schematic diagram of the preferred power pack circuitry of the invention illustrating the connector facing upward to receive the plug from the lamp assembly.
Figure 5:
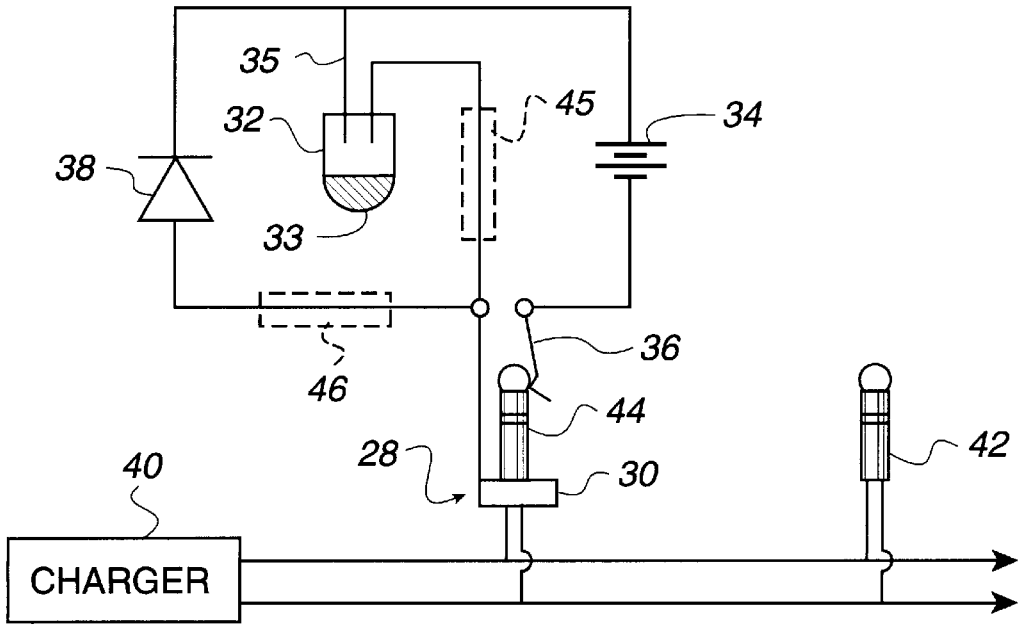
FIG. 5 is the schematic diagram of FIG. 4 inverted and connected to a battery charger.

The preferred circuitry within the power pack 10 of FIG. 2 is shown in FIG. 4 and inverted with a battery charger in FIG. 5. FIG. 4 shows the single phone jack 28 facing upward as illustrated in FIG. 1. The ground contact 30 of the jack is connected through the discharge circuit 45 to a gravity controlled switch, such as a mercury switch 32 to the positive terminal of the battery 34, the negative terminal of which is connected to the second contact 36 of the phone jack 28. A diode 38 is in parallel with the switch 32 but is reverse biased so that negligible current flows through the diode from the battery.

FIG. 5 illustrates one power pack being charged with a battery charger 40 with an output comprising a plurality of phone plugs 42 in parallel. The power pack is now inverted with the phone jack 28 facing downward. In this position the mercury 33 in the mercury switch is not in contact with the wire leads 35 in the switch and so the mercury switch 32 is not in the circuit. Now, current flows from the battery charger 40 and through the contact 30, through the charge circuit 46, through the now-forward biased diode 38 to the battery 34 and back to the charger 40. Diode 38 is in the circuit to protect against developing possible short circuits in the charger plugs as described in U.S. Pat. No. 5,587,646, issued Dec. 24, 1996.

We claim:

1. A power pack for a battery operated accessory coupled to a two-element connector, said power pack comprising:

a housing containing a rechargeable battery having a first and a second terminal, a first circuit extending from said first battery terminal to a connector on said housing, said connector adapted to connect with a two-element connector of a battery charger, said first circuit including an isolating diode between said connector and said first battery terminal, said diode permitting a current flow only from said connector into said battery; and a second circuit extending from said first battery terminal to said connector on said housing, said connector adapted to connect with the two-element connector of a battery operated accessory, said second circuit including a gravity controlled switch between said connector and said first battery terminal, a closure of said switch permitting current to flow from said battery only when said connector is coupled to the two-element connector of the battery operated accessory.

2. The power pack claimed in claim 1 wherein said battery operated accessory is a lamp.

3. The power pack claimed in claim 1 wherein the two-element connector of the battery operated accessory is a phone plug and the connector in said power pack is a phone jack.

4. The power pack claimed in claim 3 wherein said power pack housing has a flat upper surface and said phone jack is centered in said surface, said housing being inverted for connection with a battery charger.

5. The power pack claimed in claim 3 wherein said gravity controlled switch is a mercury switch.

6. In combination with a lamp assembly having a hollow base, a chimney extending from the center of said base, a lamp positioned on top of said chimney, a phone plug extending from the bottom of said chimney and extending into said hollow base, and electrical conductors extending from said lamp through said chimney to said phone plug, a power pack comprising:

a power pack housing under the hollow lamp assembly base, said housing containing a battery having positive and negative terminals;

a first circuit extending from both of said battery terminals to a discharge phone jack in the surface of said housing, said lamp phone plug being connected to said discharge phone jack; and a second circuit, isolated from said first circuit, extending from both of said battery terminals to a charge phone jack in said housing.

7. The combination claimed in claim 6 wherein said discharge phone jack is said charge phone jack and wherein said first circuit includes a gravity controlled switch which is conductive only when said phone jack is oriented to engage said phone plug, and wherein said second circuit includes an isolating diode permitting a current flow only from said phone jack to said battery.

8. The power pack claimed in claim 7 wherein said gravity controlled switch is a mercury switch.

* * * * *